US009697704B1

(12) United States Patent
Zhu et al.

(10) Patent No.: US 9,697,704 B1
(45) Date of Patent: Jul. 4, 2017

(54) SEARCHABLE BINDER WITH SECURITY LOCK

(71) Applicants: Shengbo Zhu, San Jose, CA (US); Su Shiong Huang, Bellevue, WA (US)

(72) Inventors: Shengbo Zhu, San Jose, CA (US); Su Shiong Huang, Bellevue, WA (US)

(73) Assignee: MICRODATA CORPORATION, San Jose, CA (US)

( * ) Notice: Subject to any disclaimer, the term of this patent is extended or adjusted under 35 U.S.C. 154(b) by 0 days.

(21) Appl. No.: 14/999,605

(22) Filed: Jun. 1, 2016

(51) Int. Cl.
*G08B 5/36* (2006.01)
*B42F 13/40* (2006.01)

(52) U.S. Cl.
CPC ..... *G08B 5/36* (2013.01); *B42F 13/40* (2013.01)

(58) Field of Classification Search
CPC . G08B 5/36; B42F 13/26; B42F 13/40; A47B 2021/062; A47B 51/00; A47B 83/001
See application file for complete search history.

(56) References Cited

U.S. PATENT DOCUMENTS 3,023,434 A * 3/1962 Fox ..... B42B 5/103 412/40
3,317,176 A * 5/1967 Herrin ..... B42F 17/08 211/43
4,315,696 A * 2/1982 Ermanski ..... B42F 13/40 281/33
4,445,799 A * 5/1984 Wright ..... B42F 15/0064 281/21.1
4,750,884 A * 6/1988 Bourgeois ..... B42F 13/0086 402/13
5,127,755 A * 7/1992 Bee ..... B42F 13/32 402/2
5,380,111 A * 1/1995 Westrom ..... B42F 13/0026 402/502

(Continued)

*Primary Examiner* — Orlando Bousono

(57) ABSTRACT

A searchable binder which is operationally compatible with a binder management system having a cabinet with shelves for removable storage of the binder. Each binder has a body with front and rear covers and a spine. Inside the body is a binder mechanism for removably retaining sheet media. Each binder has a binder contact mechanism mounted to the spine at the upper end, a binder lock mechanism mounted to the spine at the lower end, a binder identification circuit electrically coupled to the binder contact mechanism and the binder lock mechanism, and a visible indicator. The binder contact mechanism has a contact element extending outwardly of the upper end of the spine and engaged with one of several first conductive shelf elements of the binder cabinet. The binder lock mechanism has a lock bolt extending outwardly of the lower end of the spine with an end portion engaged with one of several grooved second conductive shelf elements of the binder cabinet to normally lock the binder in the cabinet. When a binder identification signal from a host computer is supplied to the cabinet conductive elements, it is transferred by the binder contact mechanism and the binder lock mechanism to the binder identification circuit. If the signal matches a binder identification code stored in the binder identification circuit, the binder lock mechanism is activated to the release position and the visible indicator is activated to aid the user in finding the binder.

10 Claims, 7 Drawing Sheets

(56) References Cited

U.S. PATENT DOCUMENTS

| | | | | | |
|---|---|---|---|---|---|
| 5,651,628 | A * | 7/1997 | Bankes | B42C 7/002 | 281/29 |
| 5,680,938 | A * | 10/1997 | Rubinstein | B42D 17/00 | 211/42 |
| 5,827,004 | A * | 10/1998 | Kim | B42F 13/22 | 402/39 |
| 5,876,131 | A * | 3/1999 | Parker | B41J 3/36 | 281/21.1 |
| 6,179,508 | B1 * | 1/2001 | Coerver | B42F 13/26 | 281/17 |
| 6,203,229 | B1 * | 3/2001 | Coerver | B42F 13/26 | 402/20 |
| 6,379,070 | B1 * | 4/2002 | Butchma | B42F 13/0006 | 281/29 |
| 2004/0042844 | A1 * | 3/2004 | Ettro | B42F 21/00 | 402/73 |
| 2007/0114892 | A1 * | 5/2007 | Boxenbaum | A47B 51/00 | 312/223.3 |
| 2008/0211361 | A1 * | 9/2008 | Boxenbaum | A47B 51/00 | 312/196 |
| 2008/0304901 | A1 * | 12/2008 | Seman | B42F 13/0033 | 402/74 |
| 2012/0093569 | A1 * | 4/2012 | Zhu | B42F 13/40 | 402/3 |
| 2013/0284873 | A1 * | 10/2013 | Sweere | F16M 13/00 | 248/351 |
| 2014/0050517 | A1 * | 2/2014 | Williams | B42F 23/00 | 402/60 |
| 2015/0114961 | A1 * | 4/2015 | Zalon | B42D 3/10 | 220/210 |

* cited by examiner

SEARCHABLE BINDER WITH SECURITY LOCK

BACKGROUND OF THE INVENTION

This invention relates to documents management in general, and specifically to an improved documents management technique using a collection of searchable binders. More particularly, this invention relates to a searchable binder with a security lock for preventing unauthorized removal of a searchable binder from a cabinet shelf.

In medical records, legal and business offices, and some homes, notebook binders (hereinafter "binders") are typically used to store documents used for medical, legal, other business and personal purposes. A typical binder has a front cover, a rear cover and a spine joining the two covers. Inside the binder, a multi-ring manually operable binder mechanism having two or more two-piece arcuate rings is permanently mounted to facilitate insertion, storage and removal of documents having a number of holes formed along a mounting edge, with the number of holes corresponding to the number of rings of the binder mechanism. Each binder is typically removably supported on a shelf by placing the bottom edges of the binder covers and spine of a closed binder on the top surface of the supporting shelf. Several binders are typically installed on a given shelf, and several shelves are typically incorporated into a shelf support structure, such as a cabinet. In order to enable the documents contained in the various binders to be readily accessed, some type of documents management system is necessary.

Documents management is typically performed by binder management. Each document is initially assigned to, and placed in, an identified binder dedicated to documents of a particular subject matter (e.g., "utility bills for a specific account"). Later-generated related documents are typically assigned to and placed in this same binder. When a binder is filled to capacity by documents, a new binder is provided for receiving additional documents of the same category.

U.S. Pat. No. 8,717,143 issued May 6, 2014 (hereinafter the'143 patent), the disclosure of which is hereby incorporated by reference, discloses a searchable binder suitable for use in a binder management system which enables quick and efficient location of binders in a document management system. More particularly, the binder management system has a cabinet with shelves for removable storage of searchable binders. Each binder has a body with front and rear covers and a spine. Inside the body is a binder mechanism for removably retaining sheet media. Each binder has externally extending upper and lower ohmic contact members which ohmically engage conductive members mounted on the shelf surfaces near the front when a binder is installed on a cabinet shelf. Each binder has a binder identification circuit coupled to an LED mounted on the binder spine in a location visible when the binder rests on a shelf. When a binder identification signal from a host computer is presented to the shelf conductive members it is transferred by the binder contact members to the binder identification circuit. If the binder identification signal matches a code stored in the binder identification circuit, the LED is activated to aid the user in finding the binder. An LED and an optional audible indicator are mounted on the cabinet to further aid the user in finding the sought binder.

While the searchable binder system described above represents a substantial improvement in the field of binder management systems, it suffers from the same disadvantage of conventional binder management systems using ordinary, non-searchable binders: namely, anyone with access to the storage space where the binder cabinets are located can remove a binder from its shelf-whether authorized or not. This is due to the fact that the binders and cabinets are designed to promote easy installation and removal of binders on the support shelves of the cabinets. More particularly, a binder can be installed on a shelf by simply placing the lower margin of the binder on a support shelf and sliding the binder rearward of the cabinet. To remove a binder, the user simply grasps the binder and pulls it outwardly of the support shelf until the binder is free and clear. With nothing to prevent removal of a binder from a shelf, binders can be easily purloined by anyone having access to the binder storage space, which compromises the integrity of the binder collection and the documents stored therein.

SUMMARY OF THE INVENTION

The invention comprises a searchable binder which incorporates a security lock that prevents unauthorized removal of a binder from a binder cabinet.

In a first aspect the invention comprises a searchable binder operationally compatible with a binder management system with at least one binder cabinet having a plurality of shelves, at least some of the shelves having a first conductive element formed on one surface thereof and a second conductive element formed in a groove on an opposite surface thereof, the conductive shelf elements providing binder identification signals. The binder comprises a binder body having a front cover, a rear cover and a spine joining the front cover and the rear cover; a binder mechanism mounted in the interior of the binder body; a visible indicator mounted on the binder body in a position visible from the outside of the binder; a binder contact mechanism secured to the spine at one end thereof, the binder contact mechanism having a contact element extending outwardly of the one end of the spine to enable engagement with one of the first conductive shelf elements of the binder cabinet when the binder is installed in the binder cabinet; a binder lock mechanism secured to the spine at the other end thereof for releasably locking the binder to one of the shelves when the binder is installed in the binder cabinet, the binder lock mechanism including a lock bolt extending outwardly of the other end of the spine and having an end portion engageable with one of the second conductive shelf elements, and a binder identification circuit mounted on the binder body and coupled to the binder contact mechanism, the binder lock mechanism, and the visible indicator for activating the binder lock mechanism and the visible indicator when a binder identification signal present on the conductive shelf elements designates the binder as a sought binder.

The binder lock mechanism preferably includes a solenoid electrically coupled to the binder identification circuit for operating the lock bolt to a retracted position when a binder identification signal present on the conductive shelf elements designates the binder as a sought binder. The binder lock mechanism also preferably includes a bias spring engaged with the lock bolt for urging the lock bolt to an extended locking position. The lock bolt preferably has a generally cylindrical configuration with a beveled end surface.

The binder contact mechanism and the binder lock mechanism are mounted at opposite ends of the binder spine, preferably with the binder contact mechanism at the upper end of the spine and the binder lock mechanism at the lower end of the spine.

In another aspect the invention comprises a binder management system comprising at least one binder cabinet having a plurality of shelves, at least some of the shelves having a first conductive element formed on one surface thereof and a second conductive element formed in a groove on an opposite surface thereof, the conductive shelf elements providing binder identification signals to searchable binders installed on the shelves; and at least one searchable binder installed between two adjacent ones of the plurality of shelves.

The binder comprises a binder body having a front cover, a rear cover and a spine joining the front cover and the rear cover; a binder mechanism mounted in the interior of the binder body; a visible indicator mounted on the binder body in a position visible from the outside of the binder; a binder contact mechanism secured to the spine at one end thereof, the binder contact mechanism having a contact element extending outwardly of the one end of the spine and engaged with one of the first conductive shelf elements of the binder cabinet; a binder lock mechanism secured to the spine at the other end thereof for releasably locking the binder to one of the shelves, the binder lock mechanism including a lock bolt extending outwardly of the other end of the spine and having an end portion engaged with one of the second conductive shelf elements, and a binder identification circuit mounted on the binder body and coupled to the binder contact mechanism, the binder lock mechanism, and the visible indicator for activating the binder lock mechanism to retract the lock bolt from the engaged one of the second conductive shelf elements and to activate the visible indicator when a binder identification signal present on the conductive shelf elements designates the binder as a sought binder.

The binder lock mechanism preferably includes a solenoid electrically coupled to the binder identification circuit for operating the lock bolt to a retracted position when a binder identification signal present on the conductive shelf elements designates the binder as a sought binder. The binder lock mechanism also preferably includes a bias spring engaged with the lock bolt for urging the lock bolt to an extended locking position. The lock bolt preferably has a generally cylindrical configuration with a beveled end surface.

As with the '143 patent binder management system, to find a searchable binder an operator may enter the appropriate binder information into a host computer, which can perform a table look-up for the binder identification information—i.e. system address, and transmit this information to all binder cabinets. When a binder identification signal is matched to a binder by the binder identification circuit, the visible indicator on the corresponding binder is activated and the user can visually identify the binder being sought. Also, the binder lock mechanism is released by the binder identification circuit so that the binder can now be removed from a shelf by the operator. In the absence of a match between the externally supplied binder identification signal and a binder, the unmatched binder remains locked in the binder cabinet.

For a fuller understanding of the nature and advantages of the invention, reference should be made to the ensuing detailed description taken in conjunction with the accompanying drawings.

DETAILED DESCRIPTION OF THE PREFERRED EMBODIMENT

Figure 1:
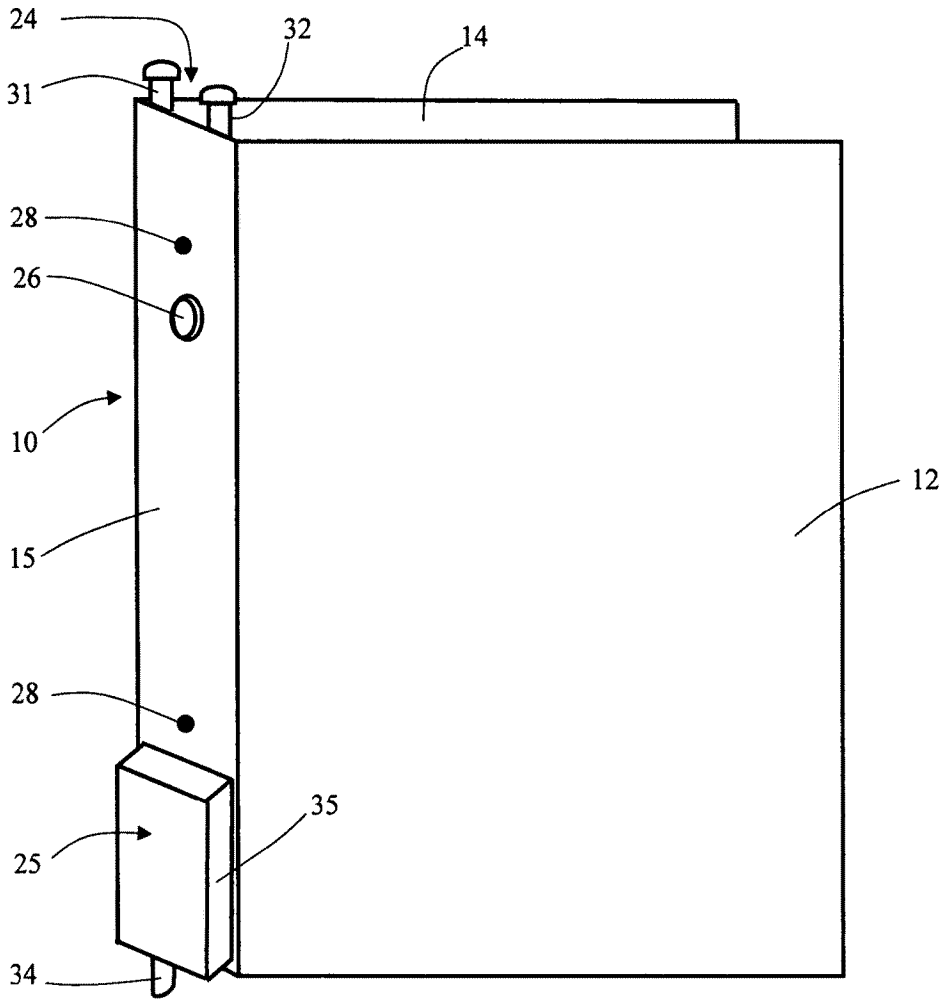
FIG. 1 is a perspective view of a binder according to the invention.
Figure 2:
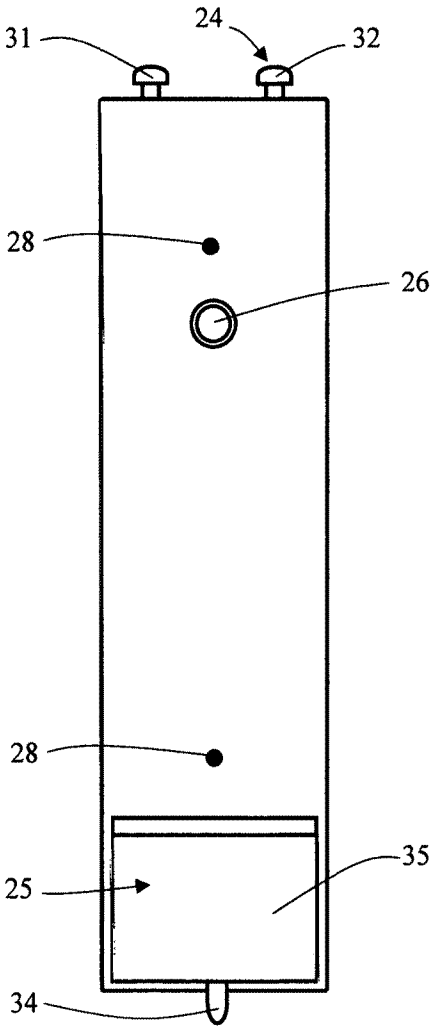
FIG. 2 is an elevational view of the spine end of the binder of FIG. 1
Figure 3:
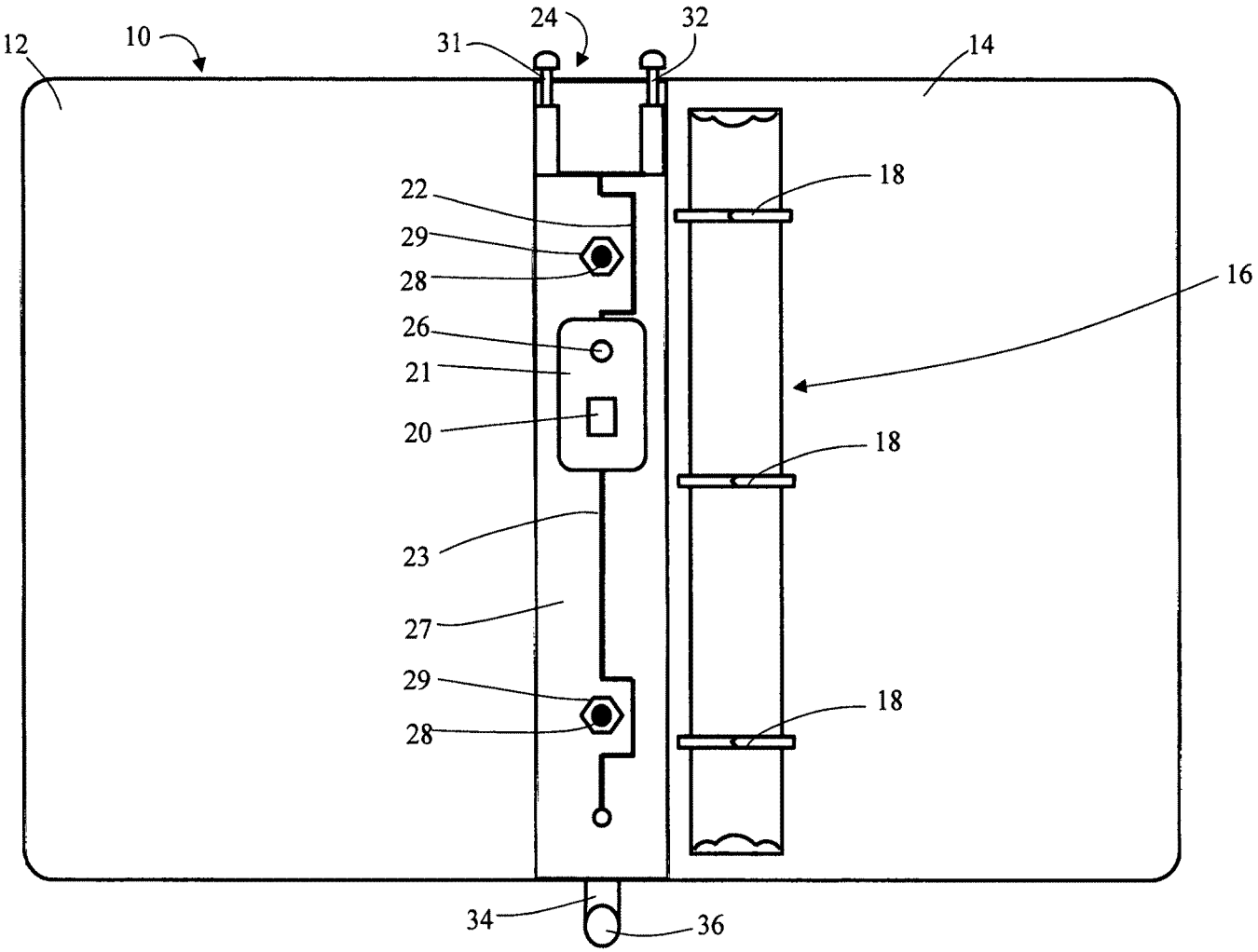
FIG. 3 is a plan view of the binder of FIG. 1 in the opened position.

FIGS. 1-3 illustrate a representative embodiment of a single binder according to the invention. As seen in these Figs., a binder 10 has a front cover 12, a back cover 14 and a spine 15 joining the front and back covers 12, 14. A conventional multi-ring manually operable binder mechanism 16 (FIG. 3) having a plurality (3 illustrated) of two-piece arcuate rings 18 is permanently mounted to the inner face of rear cover 14 to facilitate insertion, storage and removal of documents having a number of holes formed along a mounting edge, with the number of holes corresponding to the number of rings 18 of the binder mechanism 16. Mounted on the inner surface of spine 15 are a binder identification circuit 20 carried by a substrate 21, a pair of ohmic conductors 22, 23, an upper binder contact mechanism 24, a binder lock mechanism 25, and a visible indicator 26, preferably an LED. Visible indicator 26 is located in an opening formed in spine 15 so as to be visible from the outer side of binder 10. Upper binder contact mechanism 24, and binder lock mechanism 25 are ohmically connected to ohmic conductors 22, 23, respectively. Binder identification circuit 20, substrate 21, ohmic conductors 22, 23, upper binder contact mechanism 24, and visible indicator 26 are all preferably mounted on a unitary mounting plate 27 which is secured to the inner surface of binder spine 15 by suitable fasteners, such as machine screws 28 and nuts 29 or rivets. As Illustrated, unitary mounting plate 27 is dimensioned to be conformable with the geometry of spine 15 so as to be accommodated thereby. Binder lock mechanism 25 is secured to binder spine by any suitable fastening mechanism, such as a strong adhesive, machine screws or the like.

Upper binder contact mechanism 24 is arranged with respect to spine 15 with a pair of laterally spaced contact elements 31, 32 thereof in a position extending outwardly of the upper margin of spine 15 as shown. Contact elements 31, 32 are spring loaded to promote sliding engagement with a conductive strip which is carried by the undersurface of the binder support shelves in the binder storage cabinet in which the binder 10 can be installed. Binder lock mechanism 25 includes a spring biased latch bolt 34 translatably mounted in housing 35 of binder lock mechanism 25. Latch bolt 34 is fabricated from a magnetizable material for a purpose described below. Latch bolt 34 is biased downwardly of the lower margin of binder spine 15 in a conventional manner to promote sliding engagement with a conductive strip which is carried by the upper surface of the binder support shelves in the binder storage cabinet in which the binder 10 can be installed. This configuration of upper binder contact mechanism 24 and binder lock mechanism 25 enables these elements to ohmically engage the conductive strips mounted on the shelves on which the binder 10 can be removably stored. Thus, when a binder identification signal from a host computer is presented to the shelf conductive members it is transferred by the binder contact mechanism 24 and the binder lock mechanism 25 to the binder identification circuit 20 via ohmic conductors 22, 23. If the received binder identification signal matches a code stored in the binder identification circuit 20, binder lock mechanism 25 is activated by the binder identification circuit 20 to retract latch bolt 34, thereby unlocking binder 10 for removal, and visible indicator 26 is activated by the binder identification circuit 20 to aid the user in locating the binder 10.

Figure 4:
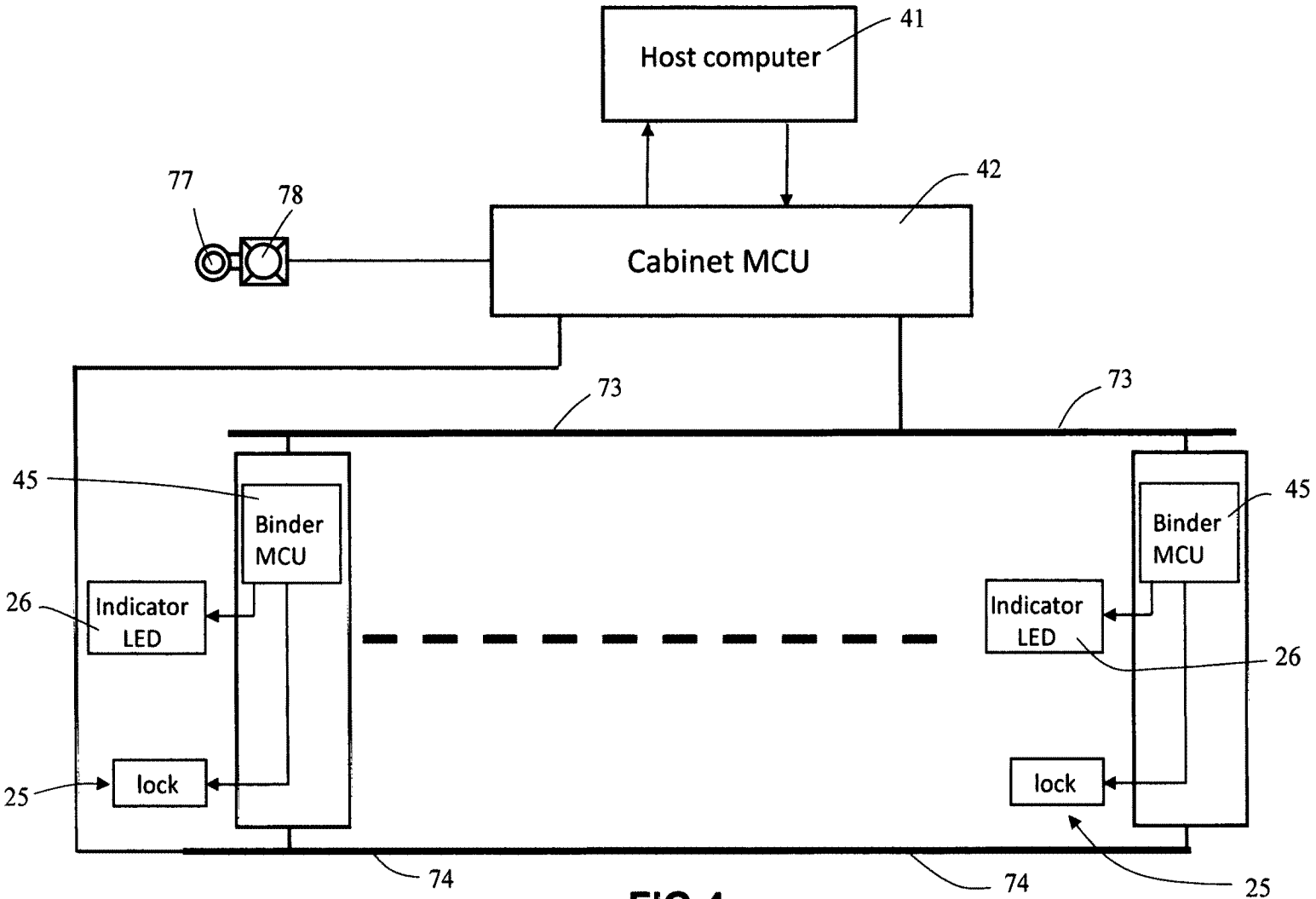
FIG. 4 is a schematic diagram illustrating the system configuration employed with the binder of FIGS. 1-3.

With reference to FIG. 4, the searchable binder system employed with the binder of FIGS. 1-3 includes a host computer 41, which stores the inventory data for all binders 10 registered in the system, and issues commands and receives responses from each cabinet micro computer unit 42 (hereinafter MCU 42) configured in the system. The communication link between host computer 41 and each cabinet MCU 42 may be either a hard-wired communication link or a wireless communication link. Each cabinet MCU 42 may comprise a type AT89C2051 device available from Intel Corporation of Santa Clara, Calif. or a type LPC 1766 device available from NXP Semiconductors of Eindhoven, The Netherlands, or the equivalent. Each cabinet MCU 42 includes internal memory for storing the cabinet identification information, a list of binder identification characters serving to identify the individual binders 10 stored in a given cabinet and the cabinet shelf on which a given binder 10 is currently located. Each cabinet MCU 42 is ohmically connected to an upper and lower ohmically conductive strip 73, 74 to supply binder search signals to the individual binders 10 in a given cabinet and receive binder found signals from a sought binder 10 located on a shelf in the cabinet. Each cabinet MCU 42 is also ohmically connected to a visible indicator 77 and an optional audible indicator 78 in order to activate these devices when a binder found signal is received from a sought binder 10. The binder identification circuit 20 in each binder 10 includes a binder micro computer unit 45 (hereinafter binder MCU 45), which may comprise a type PIC16F1823 device available from Microchip Technology, Inc. of Chandler, Ariz. Each binder MCU 45 has an internal memory for storing the binder identification information for that binder 10 and will generate a binder found signal when the incoming sought binder information matches the binder identification information stored in memory. Each binder MCU 45 also is configured to generate an activation control signal for operating the binder lock mechanism 25 for that binder 10 to the unlocked state, and to generate an activation control signal for the visible indicator 26 of binder 10 whenever the incoming sought binder information matches the binder identification information stored in memory.

Figure 5:
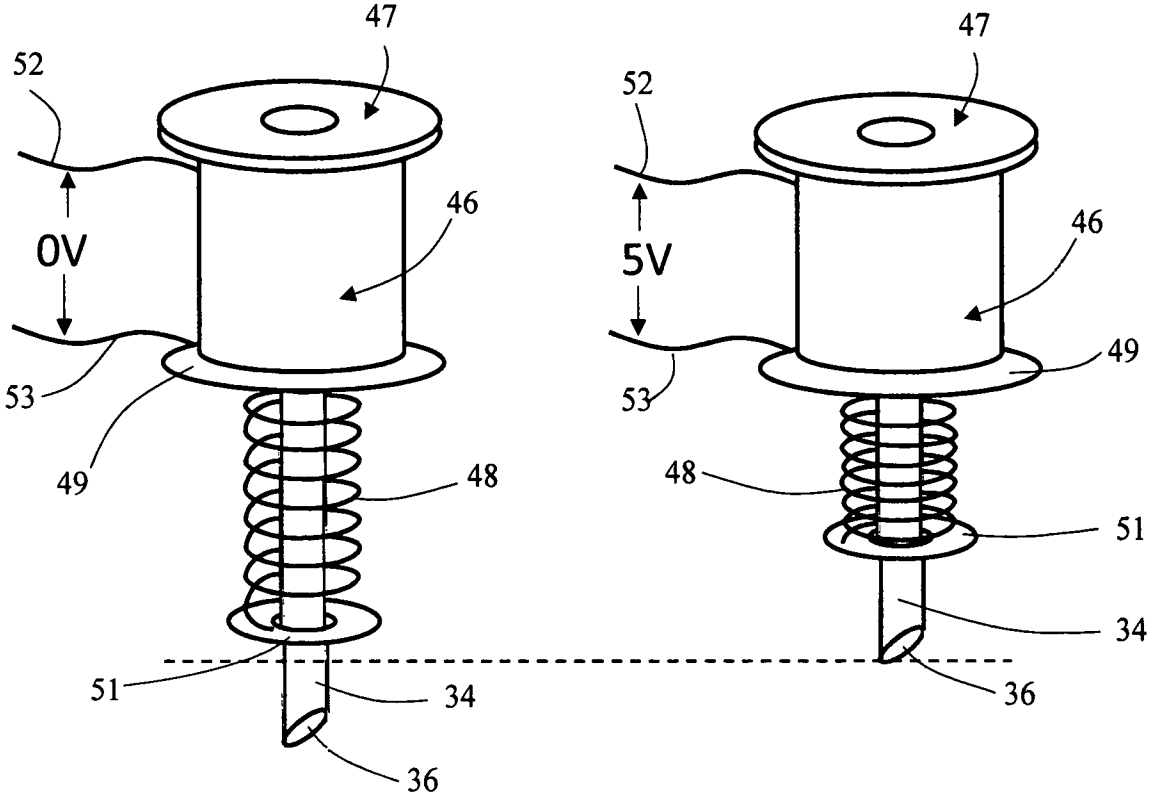
FIG. 5 is a perspective view showing the binder lock solenoid mechanism in the locked and unlocked positions.

FIG. 5 is a perspective view showing the binder lock solenoid mechanism in the locked and unlocked positions. The locked position is illustrated to the left in FIG. 5, while the unlocked position is illustrated to the right in FIG. 5. As seen in this Fig., the lock solenoid mechanism is a conventional design including a coil 46 wound about a spool 47, a bias spring 48 captured between the lower flange 49 of spool 47 and a keeper flange 51 secured to lock bolt 34. A pair of ohmic conductors 52, 53 provides D.C. power to coil 46 from binder MCU 45. In the unactivated state shown to the left in FIG. 5 (the locked position), no D.C. power is supplied from binder MCU 45 to the binder lock solenoid mechanism coil 46 so that bias spring 48 urges lock bolt 34 in the downward direction to a mechanical limit. In the activated state (the unlocked position), D.C. power is supplied from binder MCU 45 to the binder lock solenoid mechanism coil 46 to generate a magnetic field which draws lock bolt 34 in the upward direction to a released position.

Figure 6:
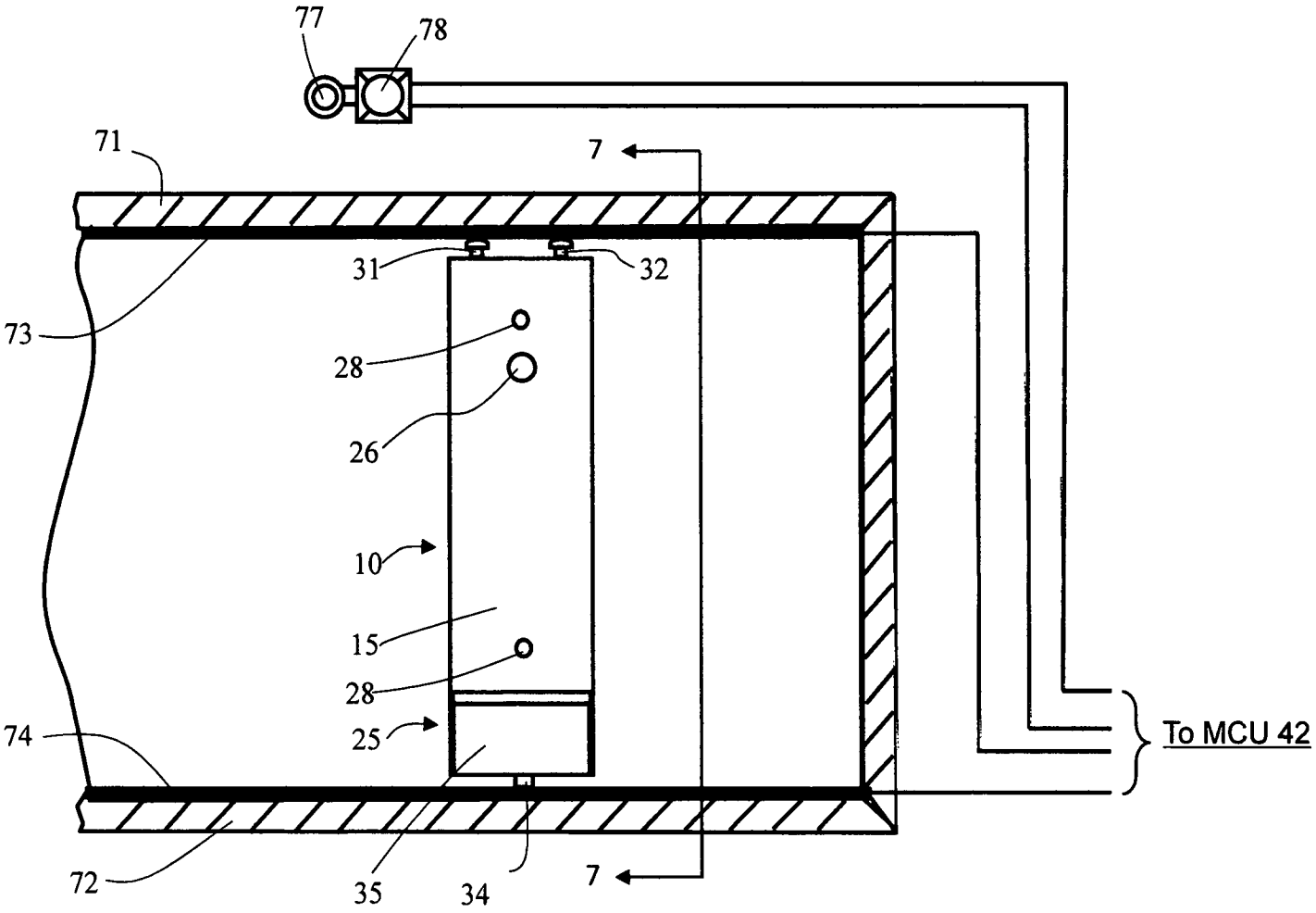
FIG. 6 is a front elevational view of a portion of a binder storage cabinet illustrating a single binder installed in the cabinet with the binder lock engaged.

FIG. 6 is an enlarged partial front schematic view of a portion of a binder storage cabinet including a top shelf 71 and a middle shelf 72 and illustrating a single binder 10 installed between shelves 71, 72. As seen in this Fig., a first laterally extending ohmically conductive strip 73 is mounted to the undersurface of top shelf 71, and a second laterally extending ohmically conductive strip 74 is mounted to the top surface of underlying shelf 72. The position of each conductive strip 73, 74 is chosen such that the top surface of contact elements 31, 32 of binder contact mechanism 24 will engage the conductive strip 73 and latch bolt 34 will engage the conductive strip 74 so as to make ohmic contact therewith whenever a binder 10 is installed on underlying shelf 72. As noted above, conductive strips 73, 74 are electrically connected to data input and output terminals of local cabinet MCU 42. Also as noted above, the local cabinet MCU 42 generates the binder identification signals identifying a sought binder and these signals are coupled to the binder identification circuit 20 in binder 10 via conductive strips 73, 74, binder contact mechanism 24, binder lock mechanism 25 and ohmic conductors 22, 23 within binder 10. A visible shelf indicator 77 and an optional cabinet audible indicator 78 are also coupled to appropriate control output terminals of local cabinet microcomputer 42 of each shelf pair to be activated by the local cabinet microcomputer 42 whenever a sought binder 10 is located on a shelf.

Figure 7:
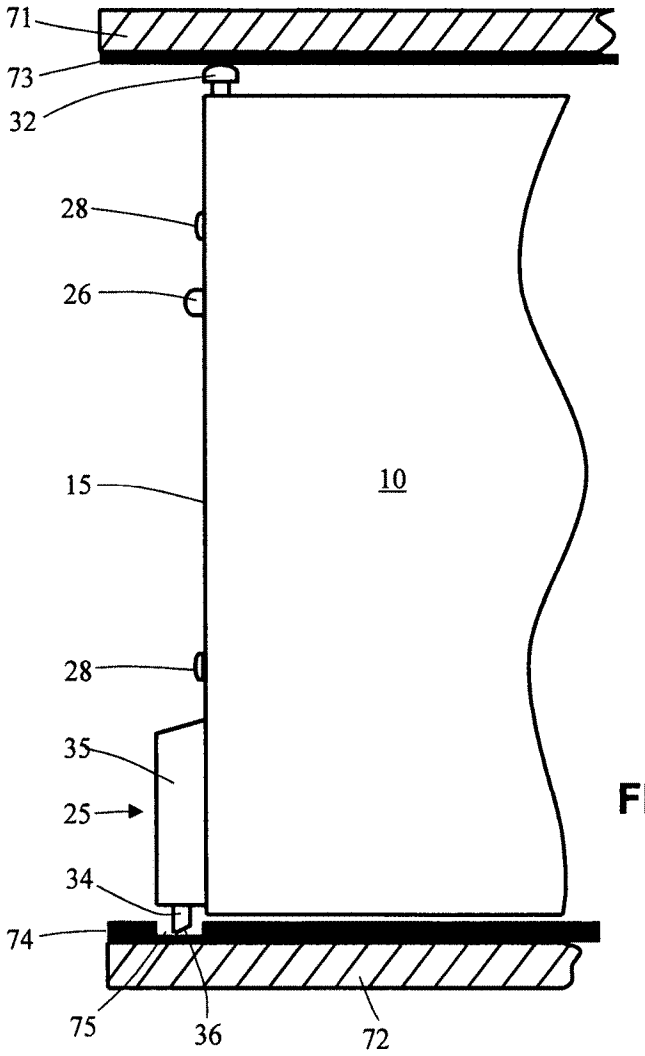
FIG. 7 is an enlarged sectional view taken along lines 7-7 of FIG. 6.

FIG. 7 is an enlarged sectional view taken along lines 7-7 of FIG. 6 illustrating the manner in which a binder 10 is locked in place on a cabinet shelf when the binder 10 is installed. As seen in this Fig., the conductive strip 74 on lower support shelf 72 has a groove 75 in which the lower end of lock bolt 34 is captured when the binder 10 is fully inserted into the binder cabinet. To facilitate this engagement, the lower end of lock bolt 34 has a beveled surface 36 facing toward the rear of the binder cabinet. When a binder 10 is initially placed in a resting position on support shelf 72 and manipulated toward the rear of the binder cabinet, beveled surface 36 engages the leading edge of conductive strip 74 and lock bolt 34 is driven upwardly against the downward biasing force of bias spring 48. As binder 10 moves rearwardly of the binder cabinet the lowermost edge of lock bolt 34 slides along the upper surface of conductive strip 74 until lock bolt 34 reaches groove 75. At this position, the downward biasing force of bias spring 48 causes lock bolt 34 to be driven downwardly into groove 75 locking binder 10 in place on shelf 72. If an attempt is subsequently made to remove binder 10 from the binder cabinet by grasping binder 10 and pulling it outwardly of the binder cabinet, the mechanical interference between lock bolt 34 and the front edge of groove 75 prevents further outward motion. Lock bolt 34 will remain in place in groove 75 until an activation signal from binder MCU 45 in binder 10 retracts lock bolt 34 to the unlocked position.

As will now be apparent, binders provided with binder lock mechanisms fabricated in accordance with the invention are capable of secure installation in binder cabinets in a manner that prevents unauthorized removal of a binder from a binder cabinet. In addition, the security afforded by the binder lock mechanism does not impair the removal of a binder from a shelf in a binder cabinet when an incoming binder identification signal matches the binder identification information stored in a binder identification circuit. More particularly, when the match condition occurs, the binder lock mechanism is activated to the released position without any operator intervention. Moreover, the invention can be retrofitted to existing binders to provide the enhanced capability afforded by the invention by simply mounting the new elements on the spine of an existing conventional binder.

Although the above provides a full and complete disclosure of the preferred embodiments of the invention, various modifications, alternate constructions and equivalents will occur to those skilled in the art. For example, binder contact mechanisms having different geometry than binder contact mechanism 24 described above with reference to the preferred embodiment may be employed. Also, if desired the structure of conductive strip 74 may be modified to include a conductive strip located in a groove formed in the upper surface of lower non-conductive support shelf 72. Moreover, the binder cabinet may be modified to provide shelves having the groove 75 formed on the lower shelf surface so that a binder 10 can be installed with the binder lock mechanism 25 positioned at the top of the binder spine 15 and the binder contact mechanism 24 positioned at the bottom of binder spine 15. In addition, if desired the binder lock mechanism 25 may be provided with a key-operated manual lock override mechanism accessible from the outer surface of the binder spine 15 in the event of a failure of the binder identification circuit 25 or the binder lock mechanism 25. Therefore, the above should not be construed as limiting the invention, which is defined by the appended claims.

What is claimed is:

1. A searchable binder operationally compatible with a binder management system with at least one binder cabinet having a plurality of shelves, at least two of the plurality of shelves each having a first conductive element formed on one surface thereof and a second conductive element formed in a groove on an opposite surface thereof, the conductive shelf elements providing binder identification signals to searchable binders when installed on said plurality of shelves, said binder comprising:

a binder body having a front cover, a rear cover, and a spine joining said front cover and said rear cover;

a binder mechanism mounted in the interior of said binder body;

a visible indicator mounted on said binder body in a position visible from the outside of the binder;

a binder contact mechanism secured to said spine at one end thereof, said binder contact mechanism having a contact element extending outwardly of said one end of said spine to enable engagement with one of the first conductive shelf elements of the binder cabinet when said binder is installed in the binder cabinet;

a binder lock mechanism secured to said spine at another end thereof for releasably locking said binder to one of the plurality of shelves when said binder is installed in the binder cabinet, said binder lock mechanism including a lock bolt extending outwardly of said another end of said spine and having an end portion engageable with one of the second conductive shelf elements, and a binder identification circuit mounted on said binder body and coupled to said binder contact mechanism, said binder lock mechanism, and said visible indicator for activating said binder lock mechanism to retract said lock bolt to a retracted position from said one of the second conductive shelf elements and to activate said visible indicator when a binder identification signal of the binder identification signals present on said conductive shelf elements designates said binder as a sought binder.

2. The searchable binder of claim 1, wherein said binder lock mechanism includes a solenoid electrically coupled to said binder identification circuit for operating said lock bolt to the retracted position.

3. The searchable binder of claim 1, wherein said binder lock mechanism includes a bias spring engaged with said lock bolt for urging said lock bolt to an extended locking position.

4. The searchable binder of claim 1, wherein said lock bolt has a generally cylindrical configuration with a beveled end surface.

5. The searchable binder of claim 1, wherein said one end of said spine is an upper end and said another end of said spine is a lower end.

6. A binder management system comprising: at least one binder cabinet having a plurality of shelves, at least two of the plurality of shelves each having a first conductive element formed on one surface thereof and a second conductive element formed in a groove on an opposite surface thereof, the conductive shelf elements providing binder identification signals to searchable binders installed on said plurality of shelves; and at least one searchable binder installed between two adjacent ones of said plurality of shelves, said binder comprising:

a binder body having a front cover, a rear cover, and a spine joining said front cover and said rear cover;

a binder mechanism mounted in the interior of said binder body;

a visible indicator mounted on said binder body in a position visible from the outside of the binder;

a binder contact mechanism secured to said spine at one end thereof, said binder contact mechanism having a contact element extending outwardly of said one end of said spine and engaged with one of the first conductive shelf elements of the binder cabinet;

a binder lock mechanism secured to said spine at another end thereof for releasably locking said binder to one of said plurality of shelves, said binder lock mechanism including a lock bolt extending outwardly of said another end of said spine and having an end portion engaged with one of the second conductive shelf elements, and a binder identification circuit mounted on said binder body and coupled to said binder contact mechanism, said binder lock mechanism, and said visible indicator for activating said binder lock mechanism to retract said lock bolt to a retracted position from said one of the second conductive shelf elements and to activate said visible indicator when a binder identification signal of the binder identification signals present on said conductive shelf elements designates said binder as a sought binder.

7. The binder management system of claim 6, wherein said binder lock mechanism includes a solenoid electrically coupled to said binder identification circuit for operating said lock bolt to the retracted position.

8. The binder management system of claim 6, wherein said binder lock mechanism includes a bias spring engaged with said lock bolt for urging said lock bolt to an extended locking position.

9. The binder management system of claim 6, wherein said lock bolt has a generally cylindrical configuration with a beveled end surface.

10. The binder management system of claim 6, wherein said one end of said spine is an upper end and said another end of said spine is a lower end.

* * * * *